United States Patent [19]

Heldt

[11] Patent Number: 4,519,278

[45] Date of Patent: May 28, 1985

[54] BRACE EXTENSION FOR LOCKING PLIERS

[76] Inventor: Carl R. Heldt, 320 S. Country Club, Tucson, Ariz. 85716

[21] Appl. No.: 495,103

[22] Filed: May 16, 1983

[51] Int. Cl.[3] ..... B25B 7/00; B25G 1/00

[52] U.S. Cl. ..... 81/427.5; 81/367; 81/73; 81/124.4; 81/180.1

[58] Field of Search ..... 81/177 R, 177 A, 177 B, 81/73, 177 G, 177 ST, 177 PP, 180 R, 180 C, 184, DIG. 1, 363, 367–380, 428 R; 7/140; 145/66–69

[56] References Cited

U.S. PATENT DOCUMENTS

| | | | |
|---|---|---|---|
| 597,101 | 1/1898 | Collings | 81/180 R X |
| 1,380,643 | 6/1921 | Eagle | 81/177 G |
| 1,537,657 | 5/1925 | Burch | 81/177 B |
| 2,237,427 | 4/1941 | Grau | 81/177 R |
| 3,253,850 | 5/1966 | Trusty | 81/428 R X |

FOREIGN PATENT DOCUMENTS

| | | | |
|---|---|---|---|
| 840339 | 1/1939 | France | 81/177 A |
| 1275144 | 9/1961 | France | 81/73 |

*Primary Examiner*—Frederick R. Schmidt
*Assistant Examiner*—Debra S. Meislin
*Attorney, Agent, or Firm*—J. Michael McClanahan

[57] ABSTRACT

An improvement to a pair of locking pliers comprising an extension to the locking pliers handle having an elongated brace for holding and turning, said brace attached in an off-set manner to a collar which in turn holds the handle of the pair of locking pliers. The collar is so off-set from the longitudinal axis of the brace extension to provide alignment of a held tool in the jaws of the locking pliers with the longitudinal axis of the brace extension in order that by rotation of the brace extension, direct rotation of the tool, such as a screw or bolt, held in the jaws of the locking pliers, is accomplished, and such may be done at a relatively long distance from the locking pliers and tool so held, additionally being accomplished with added torque and speed over use of the locking pliers without the improvement.

2 Claims, 7 Drawing Figures

BRACE EXTENSION FOR LOCKING PLIERS

BACKGROUND OF THE INVENTION

It is all to often common in construction or repairing of structures, that there arises the necessity of driving a screw through metal or wood or threading a bolt through a nut where the receiving wood, metal or nut is at a distance from the mechanic or in a position such that the mechanic can not gain access to it. Such as an example may be if a mechanic were working through a pipe or opening and needed to thread a bolt or the like or place a screw into a structure interiorly to the pipe or opening, but the structure was well out of reach of the mechanic. In addition, it may be useful to thread a screw or a bolt into a wood or metal surface from a standing position rather than a crouching position for various reasons, not the least of to avoid strain to the body. This would be especially true if a large number of screws or bolts need to be emplaced, such as may be necessary when working on a roof, for example, when removing or applying screws used to hold tile down on a roof. In removing screws, the screw head may be readily accessible, however, it may be necessary for one to crawl along the roof to remove these screws and that may create an undesirable physical hardship. In such cases, although screwdrivers may be utilized, it is much more common for a worker to utilize a pair of locking pliers to grab the head of the screw since there is less likelihood that the head will slip through the jaws as is common when attempting to insert or remove the screw with screwdrivers. Many times nails are used to hold down clay tile on roofs. If a claw hammer is used to remove the nails, there is a great potential for breaking the tiles. It is common to grasp the nail heads with locking pliers and twist and pull to remove the nails. It is obvious that there is a need to expedite the removal of such nails.

To this end, it would be advantageous to provide means whereby a workpiece such as a screw or a bolt may be placed in the jaws of locking pliers, and then the locking pliers operated at a distance by an extension device. Additionally, if a screw or bolt is being removed and it is readily accessible to the mechanic, the locking pliers' jaws may be used to grasp the workpiece and the party be in a position away from the workpiece when the necessary turns are made to the workpiece to remove it while being able to apply much more leverage through the use of the brace, and to increase the speed of rotation.

SUMMARY OF THE INVENTION

The subject invention defines a means by which a person may operate a pair of locking pliers at a distance and to rotate the tool along a longitudinal axis for the turning of screws or bolts. To this end, an invention has been devised consisting of extension means for attachment to the handle of a pair of locking pliers, the extension means comprising a rotatable brace attached to an adapting collar which encompasses the handle of the locking pliers in a special configuration dictated by the construction of the locking pliers, so that the workpiece, screw or bolt or similar workpiece, held in the jaws of the locking pliers is in alignment with the elongated shank of the rotatable brace. By such means, the mechanic has all the advantages of the locking pliers even though the particular placement of the workpiece to be emplaced is not normally reachable by locking type pliers absent an extension.

To accomplish the above, it is necessary that the brace shank axis should be aligned with the off-set jaws of the locking pliers and to do so requires that the collar portion of the invention which attaches to the handle of the locking pliers be off-set by the same angle as the jaw throat of the locking pliers are off-set to the locking pliers' handle. In alternate embodiments suggested by the Inventor for use where the jaw throat of the locking pliers are in alignment with the locking pliers' handle, the collar grasping the locking pliers' handle is in direct axial alignment with the shank of the extension brace.

It is an object of the subject invention to provide means by which locking type pliers having off-set jaws may be held in an extension device whereby the locking type pliers may be operated at a distance.

It is another object of the subject invention to provide means where a locking type pliers may be operated and used at a distance to rotate a workpiece, such as a screw or bolt.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in claims.

BRIEF DESCRIPTION OF THE DRAWINGS

For further understanding of the nature and object of the present invention, reference should be had to the following detailed description taken in connection with the accompanying drawings wherein.

In the various views, like index numbers refer to like elements.

DETAILED DESCRIPTION OF THE PREFERRED EMBODIMENT

Figure 1:
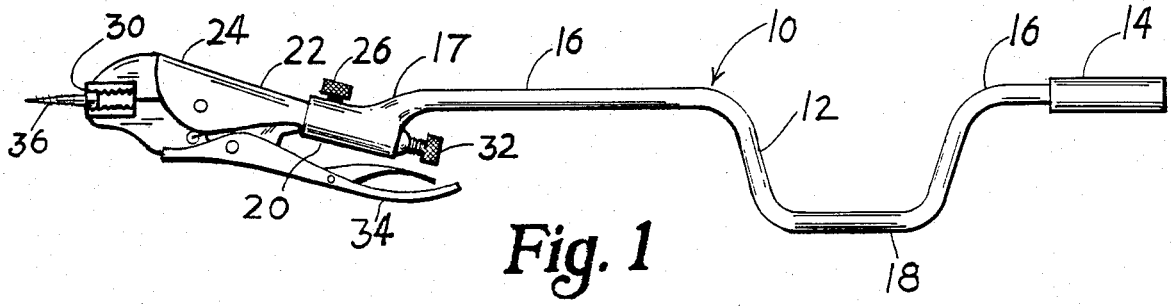
FIG. 1 is a side view of the subject invention.

Referring now to FIG. 1, a side view of the subject inventive brace extension 10 to a pair of locking pliers is shown. Beginning generally at the right hand portion of FIG. 1 and moving left, brace 12 is first shown, having at its far right hand side, rotatable handle 14 encompassing the end of shank 16, rotatable handle 14 adapted to be grasped by an operator and held firmly and stationary while the brace 12 is rotated. Brace 12 comprises the elongated shank 16 interrupted by off-set handle 18. Off-set handle 18 is held by the operator's other hand and by the operator's circular motion, the brace 12 is rotated. Both portions of elongated shank 16 shown are in axial alignment.

At the left end of brace 12 is cylindrical collar piece 20 adapted to attach to the handle 22 of the locking pliers. Collar piece 20 slips over the elongated portion of handle 22 of the locking pliers 24. Collar piece 20 is held fixedly in place upon handle 22 by means of top located co-acting set screw 26 and bottom located key 28 (FIG. 2) which protrudes interiorly to collar piece 20 on the side opposite set screw 26.

Figure 3:
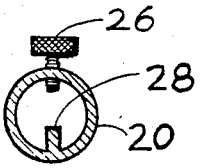
FIG. 3 is an end view of the collar of the subject invention.

Locking pliers 24 is constructed in its handle 22 portion by rolling over sheet metal from the top portion in a somewhat circular fashion until the metal sides almost join together at the bottom to form a completed circle. However, there is at the bottom edges of the rolled over metal an elongated groove, which elongated groove receives the key 28 formed interiorly to cylindrical collar piece 20. The key as shown in FIG. 3 need not have an especially long length, but only needs be sufficiently long to hold the handle of the locking pliers as it is being turned.

Set screw 26 comprises a threaded shank with a knurled knob atop it, the threaded shank residing in a threaded hole formed through the top of collar piece 20, the threaded shank adapted to engage the top portion of handle 22 of locking pliers 24.

The throat of jaws 30 of locking pliers 24 are off-set from the center axis of handle 22 of the locking pliers. Therefore, the center axis of collar piece 20 which encircles the handle 22 must be off-set from the center axis of shank 16 in order for the brace 12 to be in axial alignment with the throat of jaws 30.

By the alignment of the throat of jaws 30 of the locking pliers to the center axis of shank 16 of brace 12, locking pliers 24 may be rotated as required for a workpiece 36, such as a screw or bolt, held in the jaws 30 to be threaded into or through wood or metal at a distance from the operator. The center axis of workpiece 36 is of course in line with the throat of the jaws 30 of locking pliers 24. The ends of the jaws are so constructed as to hold workpiece 36 in this alignment.

It is noted that if the brace 12 were aligned with the axis through handle 22 for off-set jaw type locking pliers 24, the rotating of the locking pliers to screw in a screw or the like workpiece as shown in FIG. 1 would have the handle extension 10 swinging in a large circle such as to scribe a circular cone, the apex of which would be at the end of the jaws 30.

The off-set between collar piece 20 and the axis of shank 16 is accomplished by off-set extension 17 being welded or otherwise attached to collar 20 at an angle which is equal to the angle between off-set jaw throat 30 and the center axis of handle 22 of locking pliers 24.

Further, collar piece 20 is so constructed of a length to terminate prior to the end of handle 22 and thereby to allow access to adjusting screw 32 of locking pliers 24.

Locking pliers 24 is commercially available and have been for a number of years known under various trademarks. No modifications to the locking pliers 24 have been made by Applicant's improvement previously described. The lever mechanism 34 of locking pliers 24 operates to close the jaws 30 after preliminary adjustments have been made to size the jaws by adjusting screw 32. The locking pliers 24 are released by means of pulling outward the inner lever shown in lever mechanism 34.

Figure 2:
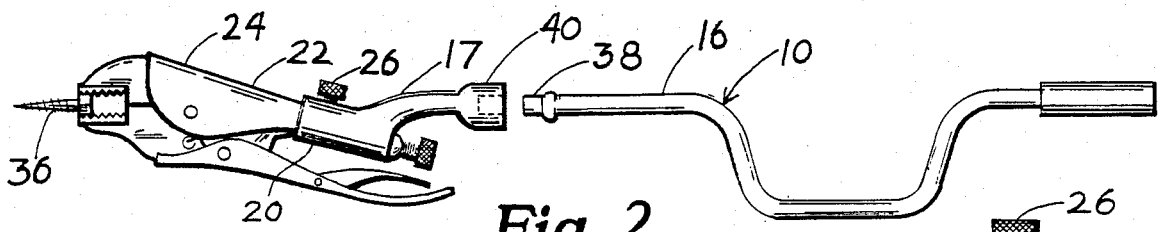
FIG. 2 is a side view of an alternate embodiment of the subject invention.

Referring now to FIG. 2, an alternate embodiment of the inventive handle extension is shown where shank portion 16 has been interrupted with a drive stud engaging fixture, the fixture comprising the squared-ended male boss 38 attached to shank 16, male boss 38 adapted to engage a four sided female socket 40 attached to collar piece 20 by off-set extension 17, all well known in the mechanic's tool art. Through such modifications, the handle extension 10 may be separated from collar piece 20 by pulling backwards away from locking pliers 24 causing the socket wrench type engaging fixture made up of elements 38 and 40 to separate. This is useful for storage of the invention, or for utilizing different sized brace extensions 10. Shank 16 of brace extension 10 may be as long as necessary to accomplish the task assigned, from a few inches long to many feet.

The relationship between boss 38 and square sided female socket 40 is a rather tight fit, however, upon the exertion of sufficient pulling force, boss 38 and socket 40 will separate. Many times it is convenient to place a spring loaded ball bearing on one of the four faces of boss 38, which ball bearing adapted to mate with a dimple formed in the interior wall of one of the four faces of socket 40. In such case, the combination provides more resistance to separation, but still will separate upon sufficiently applied oppositely directed force.

The remainder of the articles and elements shown in FIG. 2 are identical in purpose and construction as the similar article shown in FIG. 1, collar piece 20 still similarly adapted to engage handle 22 of locking pliers 24.

FIG. 3 shows an end view of collar piece 20 detailing the cylindrical shape of collar piece 20, set screw 26 which resides above collar piece 20, and the key 28 which protrudes inwardly collar piece 20 and located opposite the set screw 26. The key may be upwardly tapered, such as to form a truncated pyramid. Shown in more detail is the threaded shank attached to the knurled knob which comprises set screw 26, the threaded shank of set screw 26 penetrating collar piece 20 through a threaded hole. In this manner, handle 22 of locking pliers 24 is engaged and secured by tapered key 28 making a snug fit in the slot of the locking pliers 24 as set screw 26 engages the top of the handle.

Figure 4:
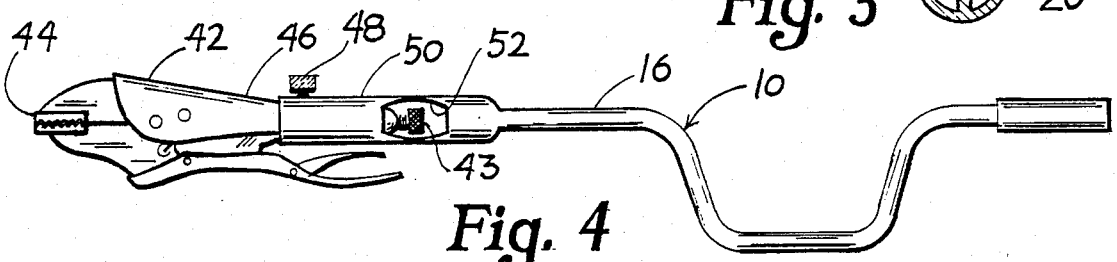
FIG. 4 is a side view of an alternate embodiment of the subject invention.

Referring now to FIG. 4, a side view of the alternate embodiment of the subject device is shown utilizing a second type of locking pliers 42, the difference between locking pliers 42 and locking pliers 24 of FIGS. 1 and 2 is that the jaw 44 throat is already aligned with the handle 36. This type of locking pliers 42 is also commercially available, being traded under various trademarks.

It is noted that with the embodiment shown in FIG. 4, collar piece 50 need no longer be off-set with respect to the brace extension 10 as it was in FIGS. 1 and 2, so it is obvious that means must be provided for access to adjusting screw 43 of locking pliers 42. Such access is provided by cutting or forming in the cylindrical walls of collar piece 50 oppositely located windows 52 which are made sufficiently large to allow adjusting screw 43 to be easily turned by holding both sides simultaneously.

The collar piece 50, like its predecessor in FIGS. 1 and 2, is cylindrical in shape having proximate the end distal to brace extension 10, set screw 48 at its top and a key (not shown) protruding inwardly its cylindrical inside surface. This key engages the groove formed by rolling the metal of locking pliers 42 into an almost completed circle when handle 46 is formed. Here again, collar piece 50 is firmly attached to handle 46 by the co-action of the key and the adjustable set screw 48.

It is to be noted in the embodiment shown in FIG. 4 that the shank portion 16 of brace extension 10 is aligned axially with the center of collar piece 50, and thus the handle 46 of locking pliers 42. In such case, the shank 16 of brace extension 10 is also in alignment with the throat of jaws 44 and the similar purposes may be accomplished with this alternate embodiment as was with the preferred embodiment shown in FIGS. 1 and 2. Here again, locking pliers 42 work similarly in operation as was described for locking pliers 24 of FIGS. 1 and 2.

Figure 5:
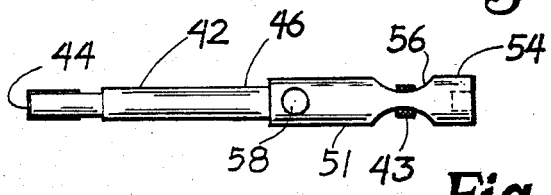
FIG. 5 is a top view of a portion of the alternate embodiment of the subject invention.

Referring now to FIG. 5, a top view of a modified version of the embodiment of FIG. 4 is shown. Here, alignment of the vertical direction is shown of all the elements of locking pliers 42, having at one end jaws 44 and at the other end handle 46 encompassed in part by collar piece 51. Collar piece 51 has been modified from collar piece 50 shown in FIG. 4 by removal of the shank 16 of brace extension 10 and the addition of a square sided female socket 54 at its end. Socket 54, like its counterpart in FIG. 2, is adapted to receive the square ended male boss. Shown more clearly in FIG. 5 is the windows 56 formed by cutting into the sides of the cylindrical collar piece 51. By the cutting out of windows 56 from collar piece 51, access to adjusting screw 43 is easily seen. On the top portion of collar piece 51 is the same set screw 58 previously described.

Figure 6:
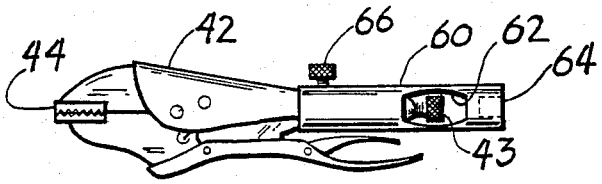
FIG. 6 is a side view of still another alternate embodiment of a portion of the subject invention.

A still further embodiment of the invention is shown in FIG. 6 where the commonly available automobile spark plug socket attachment has been adapted to the subject invention for the type of locking pliers whose jaw throat is in alignment with the handle. Referring specifically to FIG. 6, the spark plug socket attachment 60 forms the collar piece, the attachment having been modified by forming of the two opposite windows 62 for access to adjustment screw 43. At the end opposite the hexagonal opening of spark plug socket 60 is the four sided ratched wrench type female socket 64. Top set screw 66 penetrates the wall of socket 60 proximate its hexagonal opening to engage the handle of locking pliers 42.

Figure 7:
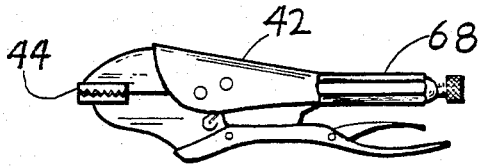
FIG. 7 is a side view of the locking pliers modified to receive an alternate embodiment of the subject invention.

Now it may be possible that set screw 66 can be set against the handle of locking pliers 42 with sufficient force to hold locking pliers 42 in firm arrangement, however, it has been found helpful to modify the handle of locking pliers 42 as shown in FIG. 7.

In FIG. 7, the rounded portion of handle 68 has been ground or formed during manufacture to the hexagonal exterior surface for mating with the same sided surface interiorly to spark plug socket attachment 60. If the handle 68 of locking pliers 42 as prepared with six sides is a relatively snug fit with spark plug socket attachment 60, set screw 66 need only be a means of holding the spark plug socket attachment 60 to locking pliers 42 to present the spark plug socket 60 from easily slipping off the handle 68.

With the preferred and alternate embodiments which have been described in the above Figures, it is readily apparent that an operator may utilize the subject invention by placing a bolt or screw in the jaws so that the longitudinal axis of the screw or bolt is aligned generally with the center axis of the locking pliers' handle, and then by placing the screw or bolt where it is desired to be screwed into a piece of wood or metal, such may be accomplished by merely rotating the rotatable brace 12 of brace extension 10. The distance from the jaws of the locking pliers to the portion which is manipulated, i.e., off-set handle 18, may be several feet or yards which previously was inaccessible to the mechanic, or too far out of reach for his hand. In this manner, the job may be accomplished very efficiently, fast, and with little effort on the part of the mechanic.

It is noted that the subject invention is especially useful when removing stud bolts and acrews with battered heads or screw slots since after the head is secured in the locking pliers jaw, it is possible to pull the invention backwards as the bolt or screws are being rotated. It is also noted that in the embodiments where the collar and the shank of the brace may be separated, such as illustrated in FIGS. 2 and 6, the locking pliers may be used in their usual fashion with the collar remaining on the locking pliers to form an extended handle.

It is further noted that the embodiment of the invention shown in FIGS. 2 and 6 are readily adaptable to the common ratchet wrench situation where the male square-ended boss of the ratchet wrench engages the female sockets shown in the Figures.

While a preferred embodiment of the subject invention together with alternate embodiments have been shown and described, it will be appreciated that still other embodiments are readily apparent and that the subject invention is not to be limited except in accordance with the appended claims.

I claim:

1. An improvement to a pair of locking pliers of the type having two jaws and a jaw throat adapted to hold a workpiece therebetween, an elongated handle having a longitudinal axis, the jaws and the jaw throat aligned in the longitudinal axis of the pliers' handle, and a jaw adjusting screw at one end of the handle for adjustment thereof, the improvement comprising:

an elongated cylindrical collar with one closed end, said collar adapted to surround a portion of the pliers' handle, said collar including a key attached interiorly to said cylindrical collar adapted to engage a channel formed in the pliers' handle, and a set screw threaded through said elongated cylindrical collar, both said set screw and said key adapted to forcibly engage the pliers' handle to hold said collar thereon, said collar further including at least two oppositely located openings in the sides of said cylindrical collar allowing entrance to the jaw adjusting screw at the end of the pliers' handle for adjustment thereof; and an elongated brace consisting of a rotatable handle portion, a shank portion, and an off-set handle portion connecting the shank portion to the rotatable handle portion, said brace rotatable handle portion and shank portion rotatable about an axis, said brace shank portion adapted to be attached to said collar whereby said elongated brace rotational axis aligns with the workpiece held in the pliers' jaw so when the pliers are desired to be put into use for extraction or rotating a workpiece held in the pliers' jaws, an operator may extract or rotate the workpiece by operation of the elongated brace.

2. The improvement for locking pliers as defined in claim 1 wherein said collar defines a female socket formed in the closed end of the cylinder, and said elongated brace shank portion includes a male boss, said male boss adapted to engage said female socket in a fixed relationship thereto.

* * * * *